US005845360A

United States Patent [19]

Lantzy

[11] Patent Number: 5,845,360

[45] Date of Patent: Dec. 8, 1998

[54] DOOR CLOSER HOLD-OPEN CLIP

[76] Inventor: John Philip Lantzy, 40 Center Ave., Chautauqua, N.Y. 14722

[21] Appl. No.: 921,932

[22] Filed: Aug. 27, 1997

[51] Int. Cl.[6] ..... E05F 3/00

[52] U.S. Cl. ..... 16/84; 16/82; 16/66

[58] Field of Search ..... 16/82, 49, 66, 16/71, 72, 84, 85, DIG. 17, DIG. 21, DIG. 10

[56] References Cited

U.S. PATENT DOCUMENTS

| | | | |
|---|---|---|---|
| 2,732,920 | 1/1956 | Newton | 16/66 |
| 3,032,806 | 5/1962 | Mallory | 16/66 |
| 3,162,889 | 12/1964 | Runnels | 16/82 |
| 3,566,435 | 3/1971 | Nakamura | 16/66 |
| 3,665,549 | 5/1972 | Quinn | 16/66 |
| 4,723,765 | 2/1988 | Pearson | 16/66 |
| 4,777,698 | 10/1988 | Lord | 16/66 |
| 4,815,163 | 3/1989 | Simmons | 16/82 |

FOREIGN PATENT DOCUMENTS

| | | | |
|---|---|---|---|
| 623038 | 7/1961 | Canada | 16/66 |

*Primary Examiner*—Chuck Mah
*Attorney, Agent, or Firm*—Richard K. Thomson

[57] ABSTRACT

A hold-open door clip can be disengaged with simple outward pressure on the door. A counterweight body section causes the clip to assume a position substantially perpendicular to the piston rod when in its free hanging position. The end of the piston housing will engage a tang that extends from the top edge of a first body section and will slide the hold-open clip freely along the piston rod.

7 Claims, 2 Drawing Sheets

DOOR CLOSER HOLD-OPEN CLIP

FIELD OF THE INVENTION

The present invention is directed to a door closer hold-open clip. More particularly, the present invention is directed to a simple hold-open clip that can be disengaged by a slight movement of the door in the open direction.

BACKGROUND AND SUMMARY OF THE INVENTION

As a convenience, door closers are typically equipped with a manually operated hold-open clip which permits the door to be held ajar so that a person with their hands filled can enter or exit more easily. However, problems can arise with such devices. For example, if a person is entering with their arms filled with groceries, they must put the bags down and return to the door to close it since most such hold-open clips must be manually slid along the piston rod to enable the piston rod to be readily retracted into the housing of the door closer.

Several other patents have attempted to deal with this problem. For example Truhon (U.S. Pat. No. 3,105,264) and Runnels (U.S. Pat. No. 3,162,889) each teach the use of hold-open clips on door closers which can be dislodged by bumping the door slightly to a more open position allowing a spring to realign the hold-open clip so that the piston rod can move freely into the housing closing the door. While the action utilized to implement the closing is similar to that of the present invention, the structure of each is quite different. Each of the Truhon and Runnels devices relies on a spring to provide a realignment force to permit door closure. Springs can jam due to canting, wear out due to rust or, in the case of the elastomeric version in Runnels, hardening or tearing. The spring in Truhon could also become dislodged and lost were the sleeve of plunger 35 to fall out of bore 233. Further, the Truhon device involves additional expense since nubs must be attached to the end of the piston housing to provide pivots for the pin 32.

The present invention provides a simple, inexpensive hold-open clip that reliably disengages when the door is moved outwardly by a bump. The hold-open clip of the present invention comprises a first section which has a throughbore that slidingly receives a piston rod of said door closer, said first section extending generally in a vertical direction when said hold-open clip is in a free hanging condition; a tang extending from a first side of said first section defining a first contact surface; a second counterweight section forming part of said hold-open clip which causes said first section to extend in said generally vertical direction in said free hanging condition; a third intermediate section which interconnects said first and second sections and defines a second contact surface; whereby when said first and second contact surfaces engage an end of a housing of said door closer, said hold-open clip is canted relative to said piston rod and locks said piston rod in a fixed position relative to said housing, and when said piston rod is extended slightly relative to said housing, said counterweight section causes said first section to extend in said generally vertical direction and said first contact surface on said tang will engage said end of said housing causing it to slide readily along said piston rod as said piston rod recedes into said housing.

BRIEF DESCRIPTION OF THE DRAWINGS

The hold-open clip for a door closer of the present invention is described in conjunction with the accompanying drawings, like elements bearing like reference numerals and, in which.

DETAILED DESCRIPTION OF THE INVENTION

Figure 1:
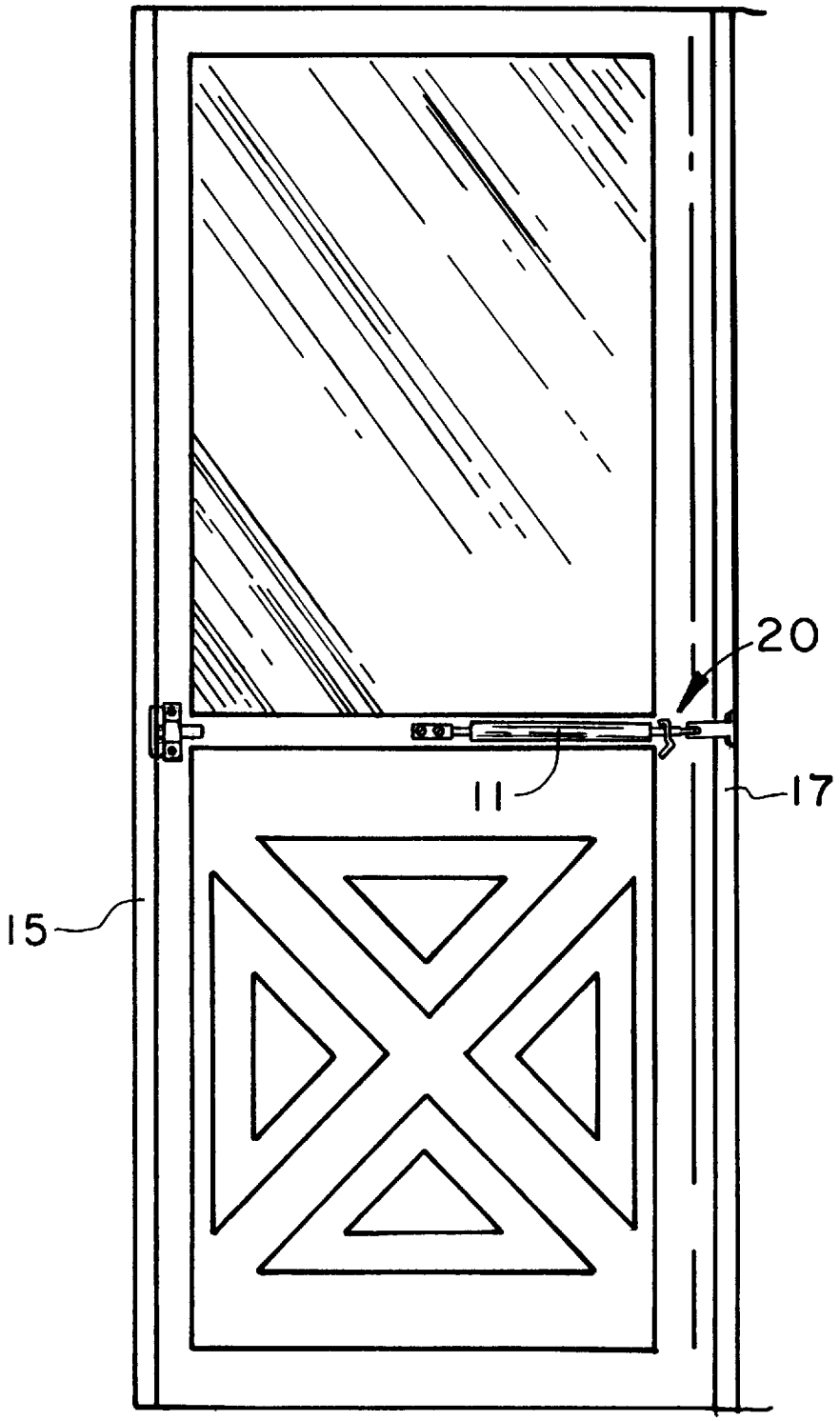
FIG. 1 is a schematic drawing of the hold-open clip on a door closer shown attached between a storm door and an associated door jamb.
Figure 2:
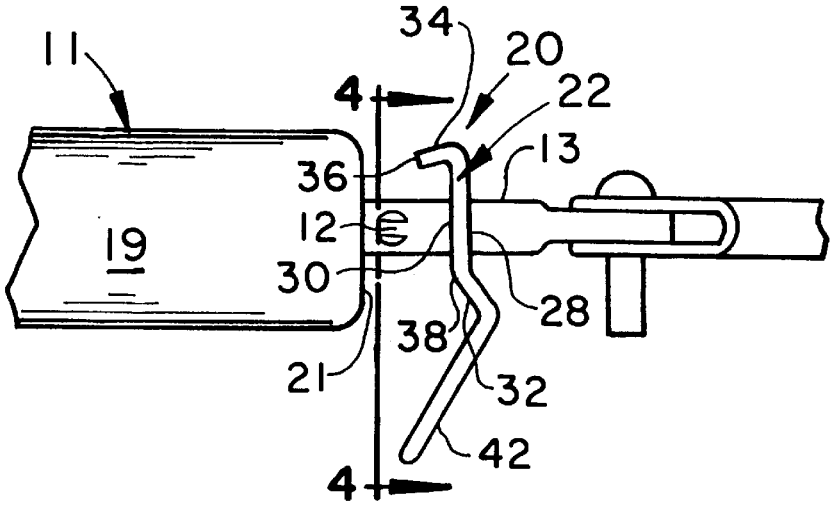
FIG. 2 is an enlarged detailed side view showing the hold-open clip of the present invention in its free hanging position.
Figure 3:
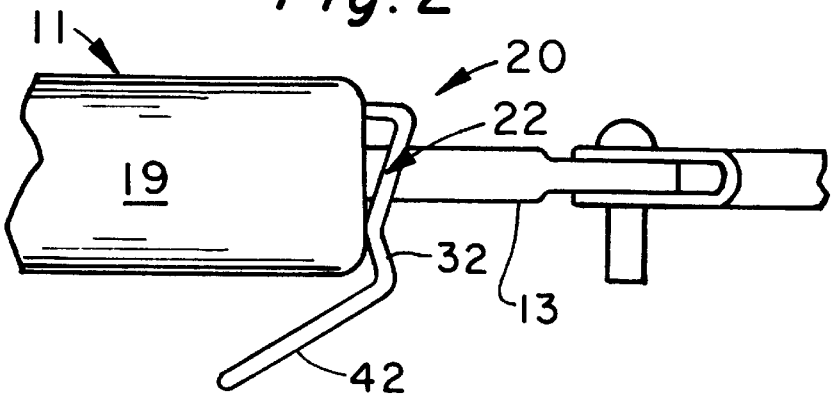
FIG. 3 is an enlarged detailed side view showing the hold-open clip engaging the end of a piston housing of a door closer to retain the door in an open position.
Figure 4:
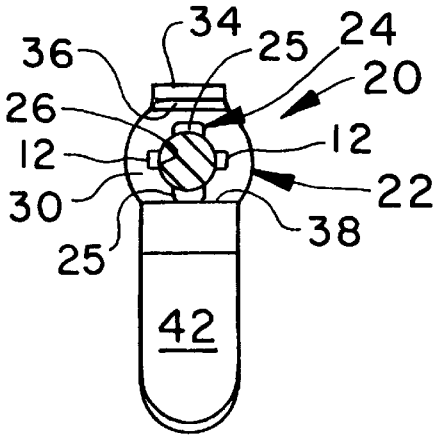
FIG. 4 is a front view of the hold-open clip of the present invention as seen along line 4—4 in FIG. 2.

The hold-open clip of the present invention is shown in FIGS. 2–4 generally at 20. Clip 20 of the present invention is shown in FIG. 1 with a conventional door closer 11 attached between screen or storm door 15 and its associated door jamb 17. Typically, door closer 11 will employ the combination of a retraction spring and an elastomeric piston which pushes against an air cushion as the trapped air is vented slowly to provide a reduced rate of closing. Any such door closer may be used with the clip 20 of the present invention. The closer 11 does not form part of the present invention but a suitable such closer is described in Truhon and, to the extent detailed description is believed to be needed to support this application, the related portion of Truhon is hereby incorporated by reference.

Hold-open clip 20 of the present invention includes a first body section 22 that is preferably generally flat and round. When clip 20 is in a free hanging position, first section 22 extends generally vertically, or orthogonal to piston rod 13. First section 22 has a throughbore in the form of a slot 24 extending between a first lateral face 28 and a second lateral face 30. Slot 24 has a generally round portion 26 that slidingly receives piston rod 13. Slot 24 also has upper and lower rectangular portions 25 to enable clip 20 to be retained behind protrusions 12 when not in use. To be engaged, clip 20 must be rotated 90° to align portions 25 of slot 24 with protrusions 12, in the same manner as is done with most such hold-open clips. A second body section 32 which is generally rectangular extends out of the plane of the first section 22 in a direction outward from said first lateral face 28.

A tang 34 extends from said second lateral face 30 at preferably an acute angle and defines a first contact surface 36. Contact surface 36 is generally planar and will engage the end 21 of housing 19 of door closer 11 in a manner to be described shortly. The intersection or juncture line between the first body section 22 and the second body section 32 defines a second contact surface 38 which is generally linear. A third generally rectangular body section 42 is connected to the second section 32 at an angle equal to or greater than 90°. Third section 42 is a counterweight section and has a configuration and sufficient mass to cause first section 22 to be oriented vertically when hold-open clip 20 is in a free hanging position.

To engage hold-open clip 20, door 15 is opened to the desired position. Clip 20 is rotated 90° around piston rod 13 to align rectangular end portions 25 of slot 24 with protrusions 12 and clip 20 is slid against the end 21 of piston housing 19. End 21 will be simultaneously engaged by first (36) and second (38) contact surfaces canting clip 20 relative to rod 13. The surfaces of slot 24 engage and lock on rod 13 locking door in the desired open position. When it is desired to permit the door to close, a slight bump outwardly on the door (movement of about ½ inch of the piston rod 13 out of housing 19) will enable counterweight section 42 to reorient first section 22 to its generally vertical position. When the door 15 is released, end 21 of housing 19 will engage first contact surface 36 only and will freely slide hold-open clip 20 along rod 13. If desired, clip 20 can be manually restored to its inoperative position behind protrusions 12 but, as can be seen, since clip 20 does not interfere with door operation, it is really unnecessary.

Various changes, alternatives and modifications will become apparent after a reading of the foregoing specification. It is intended that all such changes, alternatives and modifications as fall within the scope of the appended claims be considered part of the present invention.

What is claimed is:

1. A hold-open clip for a door closer comprising a) a first section which has a throughbore for slidingly receiving a piston rod of said door closer, said first section extending generally in a vertical direction when said hold-open clip is in a free hanging condition;

b) a tang extending from a first side of said first section defining a first contact surface;

c) a second counterweight section forming part of said hold-open clip which causes said first section to extend in said generally vertical direction in said free hanging condition;

d) a third intermediate section which interconnects said first and second sections and defines a second contact surface;

whereby when said first and second contact surfaces engage an end of a housing of said door closer, said hold-open clip is canted relative to said piston rod and locks said piston rod in a fixed position relative to said housing, and when said piston rod is extended slightly relative to said housing, said counterweight section causes said first section to extend in said generally vertical direction and said first contact surface on said tang will engage said end of said housing causing it to slide readily along said piston rod as said piston rod recedes into said housing.

2. The hold-open clip of claim 1 wherein said first section is generally circular.

3. The hold-open clip of claim 1 wherein said tang forms an acute angle with said first section.

4. The hold-open clip of claim 1 wherein said third intermediate section forms an angle with said second counterweight section of at least 90°.

5. A hold-open clip for a door closer comprising a) a first generally circular body section having a first lateral face and a second lateral face;

b) an elongated slot extending through said circular body section between said lateral faces, said elongated slot having a generally circular portion for slidingly receiving a piston rod of said door closer;

c) a second generally rectangular body section extending from a first side of said first body section out of plane with said first body section in a direction outward from said first lateral face of said first body section, said second generally rectangular body section forming a juncture line with said first section;

d) a third generally rectangular body section extending from a second side of said first body section out of plane with said first body section in a direction outward from said second lateral face of said first generally circular body section, said third generally rectangular body section forming a tang and having a planar terminus;

e) a fourth generally rectangular body section extending from a distal end of said second generally rectangular body section and being angled in a direction extending outward from said second face of said first body section, said fourth generally rectangular body section comprising generally one half of an overall length of said hold-open clip such that said fourth generally rectangular body section has sufficient mass to cause said hold-open clip to hang so that said first body portion extends generally vertically in a free hanging condition;

whereby when said hold-open clip is manually slid along said piston rod when said piston rod is in an extended position to engage an end portion of a housing of said door closer, said tang and said juncture line engage said housing so as to skew said hold-open clip on said piston rod and lock said piston rod in said extended position, and when a door to which said housing is attached is moved slightly to a more open position, said fourth generally rectangular body section will cause said hold-open clip to hang in its free hanging position and said tang will be engaged by said housing such that said hold-open clip slides freely along said piston rod as it re-enters said housing.

6. The hold-open clip of claim 5 wherein said tang forms an acute angle with said first body section.

7. The hold-open clip of claim 5 wherein said fourth generally rectangular body section forms generally about a right angle with said second rectangular body portion.

* * * * *